US005154351A

United States Patent [19]

Takko

[11] Patent Number: 5,154,351

[45] Date of Patent: Oct. 13, 1992

[54] DISPERSION WATER NOZZLE

[76] Inventor: Pauli Takko, Surviaisenkuja 2, SF-01490 Vantaa, Finland

[21] Appl. No.: 603,690

[22] PCT Filed: Mar. 7, 1990

[86] PCT No.: PCT/FI90/00061

§ 371 Date: Nov. 8, 1990

§ 102(e) Date: Nov. 8, 1990

[87] PCT Pub. No.: WO90/10502

PCT Pub. Date: Sep. 20, 1990

[30] Foreign Application Priority Data

Mar. 10, 1989 [FI] Finland ..... 891146

[51] Int. Cl.[5] ..... B05B 15/02

[52] U.S. Cl. ..... 239/110; 239/468

[58] Field of Search ..... 239/581.1, 468, 396, 239/463, 104, 106, 107, 110, 111

[56] References Cited

U.S. PATENT DOCUMENTS

| | | | |
|---|---|---|---|
| 511,728 | 12/1893 | Deming | 239/396 |
| 576,762 | 2/1897 | Palmer | 239/396 |
| 676,526 | 6/1901 | Anderson | 239/396 |
| 1,273,349 | 7/1918 | Filbin | 239/581.1 X |
| 2,965,313 | 12/1960 | Jay | 239/581.1 |
| 4,418,640 | 12/1983 | Dettelbach et al. | 239/110 X |
| 4,671,308 | 6/1987 | Williams et al. | 137/72 |
| 4,778,111 | 10/1988 | Leap | 239/581.1 X |
| 4,819,892 | 4/1989 | Rosenberg | 239/581.1 |

FOREIGN PATENT DOCUMENTS

| | | | |
|---|---|---|---|
| 1436819 | 3/1966 | France . | |
| WO90/184 | 4/1984 | PCT Int'l Appl. | 239/106 |
| 8223 | of 1911 | United Kingdom . | |
| 1444027 | 7/1976 | United Kingdom . | |

*Primary Examiner*—Kevin P. Shaver
*Assistant Examiner*—Kevin P. Weldon

[57] ABSTRACT

A dispersion water nozzle passes pressurized water containing dissolved air into a flotation clarifier. A throttle part of the nozzle is composed of a cylinder or spherical valve member, into which, the main flow through passage and a crosswise flow through passage are formed. The crosswise flow through passage has a smaller cross-sectional area. The throttle part is followed by a tubular flow equalization part. The nozzle is easy to clean by changing the flow passages and flow directions in the throttle member.

17 Claims, 4 Drawing Sheets

DISPERSION WATER NOZZLE

BACKGROUND OF THE INVENTION

The present invention concerns a nozzle which is used in pressure-water flotation clarifiers to release the air dissolved in the water under pressure as bubbles of a size suitable for the flotation process.

DESCRIPTION OF THE BACKGROUND ART

The process to which the invention is related is in itself known, and it is based on Henry's law, i.e. the solubility of a gas in a liquid is proportional to the partial pressure of the gas. In pressure-water flotation clarifiers, this is utilized by dissolving air into water at a pressure of about 2 to 8 bars. This water, saturated with air, is passed to the flotation clarification basin through pressure reduction members. When the pressure in the water flow is suddenly lowered, air is released as small bubbles. The air bubbles adhere to the solid particles to be removed and raise them to the surface of the water to be clarified.

SUMMARY OF THE INVENTION

The function of the pressure reduction member, for which the designation dispersion water nozzle is used in connection with the present patent application, is:

- to lower the pressure in the dispersion water flow,
- to produce bubbles of specified size (about 100 μm) out of the air that is released from the water on reduction of pressure, and
- to distribute the air bubbles in the water to be clarified as uniformly as possible.

The main parts of the dispersion water nozzle are a throttle part that operates as the pressure reduction part as well as an equalizing part, such as an expansion means or member.

The invention is expressly concerned with the construction of a flow throttle operating as a pressure reduction part.

As is known in the prior art, needle valves, diaphragm valves, globe valves, or fixed holes made from metal or plastic have been used as a throttle.

As an expansion member, tube parts or labyrinths made from plastic or metal are used.

Nozzles of different types have different properties in operation. The air bubbles produced must be of correct size. If the bubbles are excessively large, the rising speed of the bubbles is excessively high, turbulence is produced which disintegrates flocks, and large bubbles do not adhere to the flocks. On the other hand, if the bubbles are too small, their rising speed is too slow.

With nozzles based on needle valves as well as with labyrinth nozzles, a good operating efficiency can be obtained, which means high proportion of bubbles of correct size. On the other hand, the efficiency of nozzles based on diaphragm valves and globe valves is poor. Of the bubbles produced, a high proportion consists of either too small or too large bubbles to produce an adequate flotation effect. In the case of such valves, for a certain flotation effect a larger amount of dispersion water is required than with nozzles of higher efficiency.

However, it is a problem in nozzles based on needle valves and in labyrinth nozzles that they are blocked. Impurities, aluminium hydroxide deposit, etc. block the nozzles in the course of time. Cleaning of the nozzles is time-consuming and causes interruptions in production.

What is of concern in the blocking of a nozzle is express blocking of the throttle part.

By means of a dispersion water nozzle in accordance with the present invention, an essential improvement has been obtained for this problem of blocking, while the bubble formation properties of the nozzle have, however, been maintained at least at the level of the prior-art needle-valve-based or labyrinth-based nozzles.

According to the basic idea of the invention, as the throttle part in the dispersion water nozzle, a member is used which is characterized in that it is a body which is rotationally symmetric in relation to at least one axis, and which is mounted rotatably around the axis of rotation in a housing provided with a flow opening perpendicular to the axis of rotation, and which throttle member is provided with two flow ducts, which are of different cross-sectional flow areas and which are perpendicular both to the axis of rotation and to each other.

The particular features of the invention come out from the accompanying patent claims. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described with the aid of the accompanying drawing which are given by way of illustration only, and thus are not limitative of the present invention, and wherein.

DETAILED DESCRIPTION OF THE PREFERRED EMBODIMENTS

For the pressurized dispersion water saturated with air, the nozzle is provided with an inlet duct 1. The inlet duct terminates in a wide flow opening which passes into the throttle member in the nozzle. In the embodiment shown, the throttle member consists of a closing member 2 of a globe valve, which is placed in a conventional valve housing provided with a flow passage. The closing member 2 comprises a conventional through flow duct 7 of a globe valve. For the purpose of rotating the closing member, the throttle includes a spindle member 3.

Figure 2:
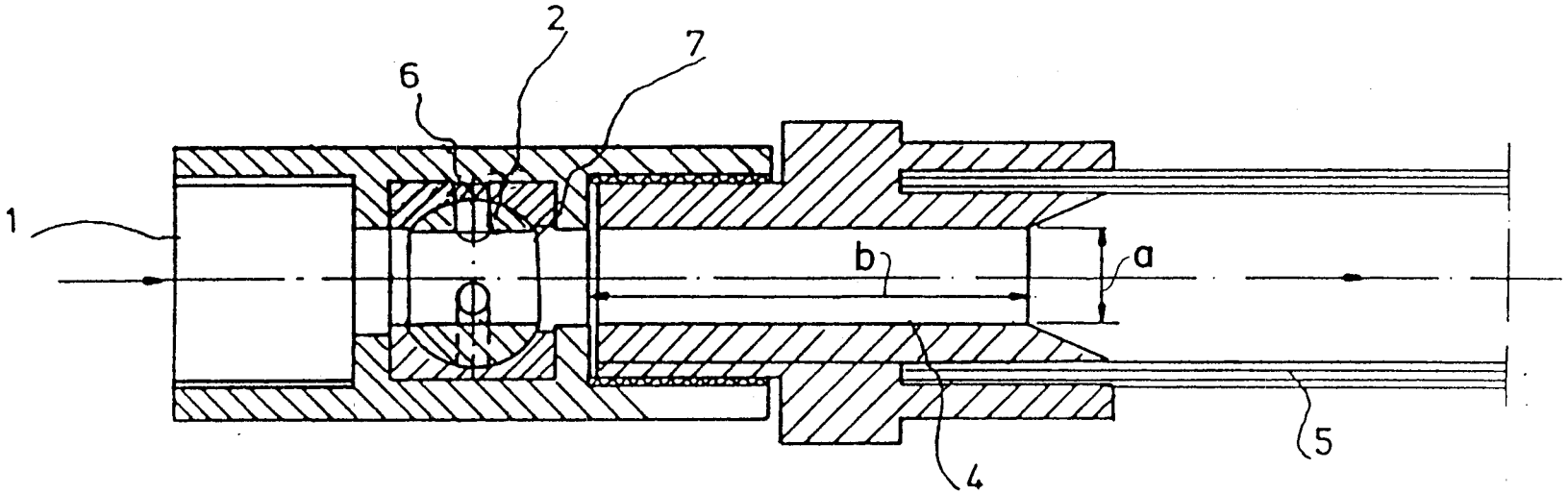
FIG. 2 is a sectional top view of a nozzle in accordance with the invention in the flushing position.

According to the basic idea of the invention, a second through flow duct 6 has been formed additionally into the closing member, the cross-sectional flow area of said duct 6 being smaller than the flow area of the flow duct 7. This additional flow duct has been made into the closing member substantially perpendicular to the main flow duct 7 so that, when the closing member is rotated by means of the spindle 3, it is possible to select either one of said flow ducts 6 and 7 to the through flow position. If the closing member 2 is rotated by 90° from its dispersion-operation position shown in FIG. 3 to the wide through-flow position shown in FIG. 2, any impurities present in expansion part 4 are flushed efficiently out of the nozzle. When the closing member is rotated further by 90° in the same direction, the flow direction in the flow duct 6 of smaller diameter is reversed, whereby any impurities present in this duct are washed off efficiently.

Figure 1:
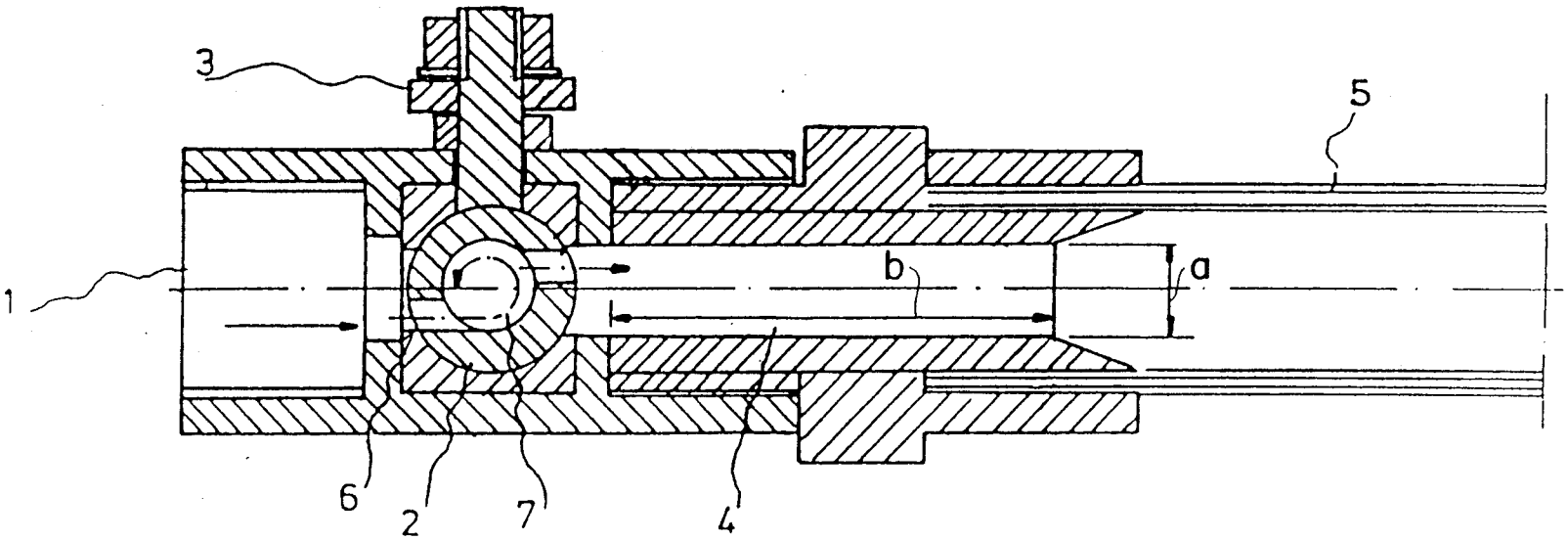
FIG. 1 is a sectional side view of a nozzle in accordance with the present invention.

According to a particular feature of the invention, the flow duct 6 has been produced so that the duct portions placed at opposite sides of the closing member 2 are not placed facing each other. In this way, a turbulent run is obtained for the dispersion-water flow (see FIG. 1) through the closing member 2, said turbulence causing a loss of energy in the flow, and thereby promoting the release of the air dissolved in the water. A crosswise positioning of the opposite portions of the flow duct 6 can be accomplished by shifting the portions of the flow duct 6 in relation to each other in the direction of the flow duct 7, or by shifting them in the direction perpendicular to said direction, possibly by using both of said shifting directions. One possibility to disturb the flow is to make the flow duct 6 portions at a little angle in relation to each other, diverging from the parallel alignment. The angular deviation may be combined with the above shifting of position.

The opposite portions of the flow duct 6 may also have different cross-sectional flow areas, in which case the nozzle is operated in the position in which the flow area at the inlet side is smaller than the flow area at the outlet side. With flow ducts 6 of circular section, the ratio of the diameters of the duct portions may be such that the diameter of the inlet-side duct is 3 mm and the diameter of the outlet-side duct is 4 mm, for example.

Generally speaking, the diameter of a circular opening used for the flow duct 6 is of an order of about 2.5 to 3.5 mm, depending on the pressure and the overall dimensioning of the nozzle that are used.

When a throttle with these dimensions is used, the following dimensions may be used for the expansion member that follows after the throttle. The length b is about 40 mm and the diameter a is about 9 mm.

In the embodiment described herein, the throttle member 2 has been described as a ball, but corresponding operations can also be achieved by means of a cylindrical piece.

Figure 3:
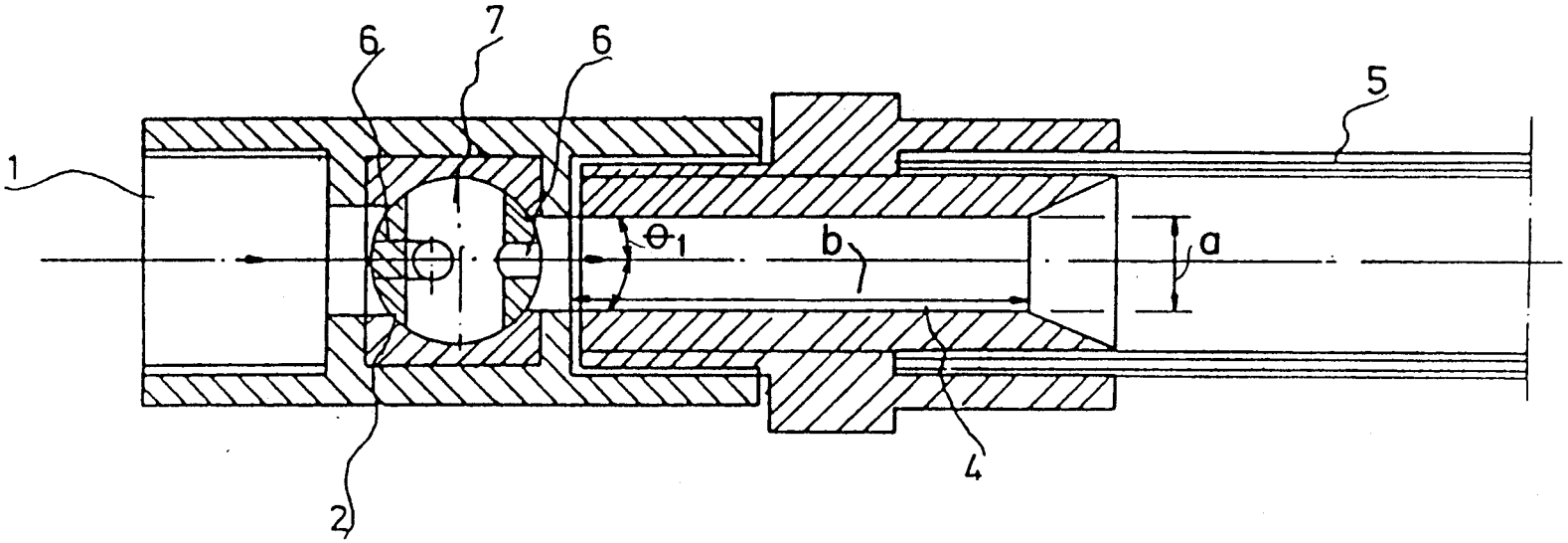
FIG. 3 is a top view of a nozzle in accordance with the invention in an operating position.
Figure 4:
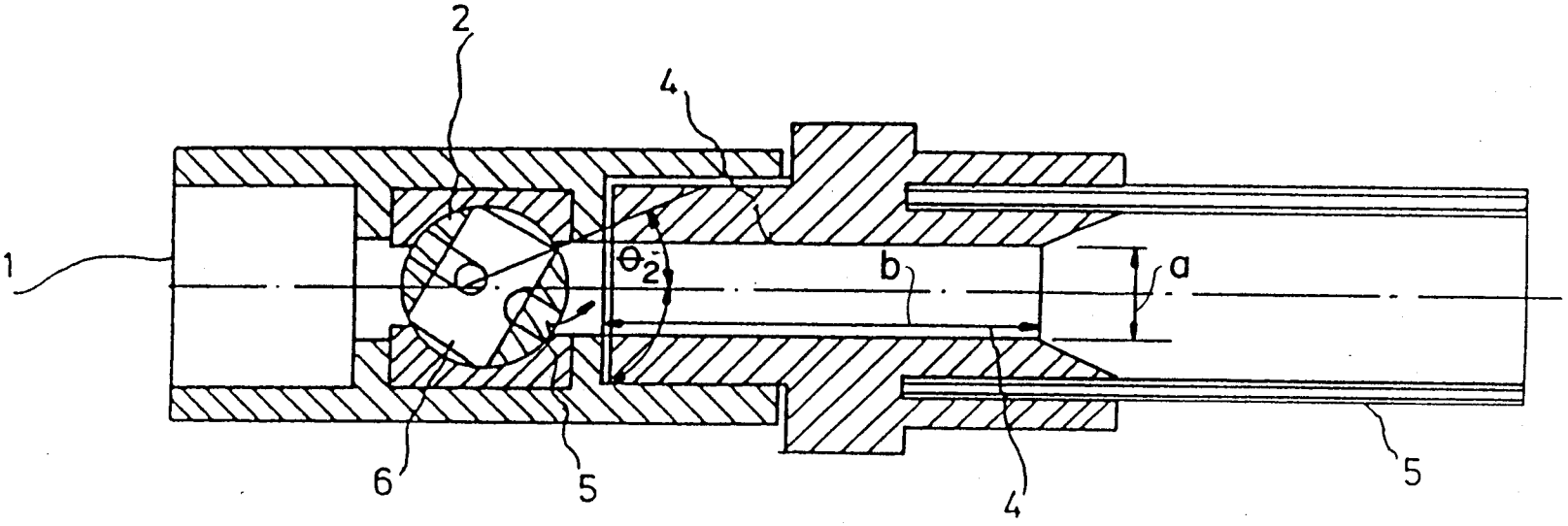
FIG. 4 is a top view of a nozzle in accordance with the invention in an alternative operating position.

FIG. 3 shows an example of the operating tolerance of the closing member 2 that is shown within which the flow opening 6 remains completely open. The position tolerance $\theta$, is 17° to both sides of the center line. In a position that exceeds this tolerance, an operating situation as shown in FIG. 4 is reached, which shows an operating advantage of the nozzle in accordance with the invention, i.e. the possibility of operating with partial load. In this FIG. 4, $\theta_2$ is between 17°-25° from the center line.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A dispersion water nozzle for use in pressure-water flotation clarifiers, said nozzle comprising a throttle member rotatable about a rotation axis, a housing in which said throttle member is located, the housing having a flow duct which is generally perpendicular to the axis, said throttle member having a flushing duct and a dispersion duct which is generally perpendicular to the flushing duct, both the flushing duct and dispersion duct being generally perpendicular to and rotatable about the axis, the flushing duct having generally a same opening diameter as the flow duct of the housing and the dispersion duct having a smaller diameter than the flushing duct, the dispersion duct crosses the flushing duct in flow connection therewith and the nozzle further comprising an expansion means for flow equalization provided in the flow duct, the expansion means being an extension member having a generally constant diameter, the dispersion duct having two sections which are offset relative to one another, one section being upstream and one section being downstream of the rotational axis when the throttle member is rotated to close the flushing duct.

2. The dispersion water nozzle as claimed in claim 1, wherein the expansion means is located downstream of the throttle member and the expansion means further prevents turbulent backflows such that air bubble size in water passing through the nozzle can be maintained.

3. The dispersion water nozzle as claimed in claim 2, wherein the expansion member generally has a length of 40 mm and a generally circular diameter of 9 mm.

4. The dispersion water nozzle as claimed in claim 1, wherein the one upstream section connects an upstream side of the nozzle to the interior of the flushing duct and the one downstream section connects the interior of the flushing duct to a downstream side of the nozzle when the throttle member is rotated such that the flushing duct is closed and the dispersion duct is opened, the sections being offset by being on different sides of the rotation axis relative to one another.

5. The dispersion water nozzle as claimed in claim 4, wherein each section of the dispersion duct has a longitudinal axis which longitudinal axes are generally parallel and noncoincident.

6. The dispersion water nozzle as claimed in claim 5, wherein the longitudinal axes are on opposed sides of the rotation axis and wherein the diameter of each section is generally uniform along the length thereof.

7. The dispersion water nozzle as claimed in claim 5, wherein the longitudinal axes are on opposed sides of the rotation axis, wherein the sections of the dispersion duct are generally circular and wherein a diameter of one section of the dispersion duct is different from a diameter of the other section.

8. The dispersion water nozzle as claimed in claim 7, wherein the diameter of the one section is generally 3 mm and the diameter of the other section is generally 4 mm.

9. The dispersion water nozzle as claimed in claim 4, wherein the interior of the flushing duct only has two openings defined therein, one opening being for the one section and the other opening being for the other section of the dispersion duct, the flushing duct interior otherwise being free of openings.

10. The dispersion water nozzle as claimed in claim 1, wherein each of the two sections have a longitudinal axis, the longitudinal axes being generally parallel, being noncoincident and being on opposed sides of the rotational axis.

11. The dispersion water nozzle as claimed in claim 1, wherein a fluid flows through the nozzle through the upstream section, an interior of the flushing duct and the downstream section to the expansion means when the throttle member is rotated to close the flushing duct, the fluid only exiting the interior of the flushing duct through the downstream section and only one downstream section being provided.

12. The dispersion water nozzle as claimed in claim 1, wherein the sections of the dispersion duct are generally circular, and wherein a diameter of one section of the dispersion duct is different from a diameter of the other section.

13. The dispersion water nozzle as claimed in claim 12, wherein the diameter of both the sections of the dispersion duct are generally uniform diameters but the diameter of one of the sections is larger than the diameter of the other section.

14. The dispersion water nozzle as claimed in claim 1, wherein the flushing duct only has two openings defined therein, one opening each for the two sections of the dispersion duct, the flushing duct interior otherwise being free of openings.

15. The dispersion water nozzle as claimed in claim 1, wherein the throttle member is a ball.

16. The dispersion water nozzle as claimed in claim 1, wherein the throttle member is a ball.

17. The dispersion water nozzle as claimed in claim 1, wherein the diameter of the flushing duct is generally constant.

* * * * *